United States Patent [19]

Slanik

[11] 4,014,076

[45] Mar. 29, 1977

[54] HOUSING WITH GROOVE

[75] Inventor: Josef Milan Slanik, Kirkland, Canada

[73] Assignee: The Bobtex Corporation Limited, Quebec, Canada

[22] Filed: Oct. 30, 1975

[21] Appl. No.: 627,365

[52] U.S. Cl. ..... 19/96; 19/236

[51] Int. Cl.[2] ..... D01G 9/16

[58] Field of Search ..... 19/105, 89, 88, 236, 19/291, 288, 150, 90, 104, 96; 57/58.91, 58.95, 58.89

[56] References Cited

UNITED STATES PATENTS

| | | | |
|---|---|---|---|
| 2,635,297 | 4/1953 | Dixon et al. | 19/89 |
| 3,335,558 | 8/1967 | Doudlebsky et al. | 57/58.95 |
| 3,685,100 | 8/1972 | Brown et al. | 19/90 X |
| 3,750,382 | 8/1973 | Minami et al. | 57/58.95 X |

FOREIGN PATENTS OR APPLICATIONS

| | | | |
|---|---|---|---|
| 703,376 | 2/1954 | United Kingdom | 19/89 |

*Primary Examiner*—Dorsey Newton
*Attorney, Agent, or Firm*—Watson, Cole, Grindle & Watson

[57] ABSTRACT

The present invention provides an improvement in a fiber drafting assembly which includes an opening roll, the improvement wherein the assembly has a housing member extending about at least a portion of the circumference of the opening roll, the housing member being characterized by having a groove located interiorly thereof.

8 Claims, 5 Drawing Figures

HOUSING WITH GROOVE

The present invention relates to an improved fiber drafting assembly, and more particularly, relates to a novel housing member which is suitable for use in a fiber drafting assembly.

Fiber drafting assemblies are known in the art and are employed for the purpose of rendering a source of fibrous material into finite fiber lengths. Generally, such a fiber drafting assembly includes means for feeding fibrous material to an opening roll which combs and drafts the fibrous material to form fibers of a finite length.

Such fiber drafting assemblies are generally employed in the manufacture of a yarn. Besides combing and drafting the fibers from the fibrous material, the assembly may also achieve a substantial parallelization of the fibers. These fibers may then be twisted into a yarn material (with or without the addition of further fibers) or be utilized as a source of fibers for the manufacture of a composite yarn as is shown in copending U.S. patent applications, Ser. Nos. 515,407 and 507,054. Both of these aforesaid copending applications teach compact apparatuses for the formation of composite yarns from particulated fibrous material — i.e. fibers. Although the improved assembly of the present invention is applicable to such apparatuses, the invention may also be utilized in any fiber drafting assembly, irrespective of its use.

Generally, the present invention provides a housing member suitable for use in a fiber drafting assembly and which housing member is adapted to receive and direct fibers doffed from an opening roll in a desired path.

According to one aspect of the present invention, in a fiber drafting assembly having an opening roll, there is provided the improvement wherein the assembly includes a housing member extending about at least a portion of the circumference of said opening roll, said member having a groove located interiorly thereof to receive fibers doffed from said opening roll and to direct the fibers in a desired path.

In a further aspect of the present invention, there is provided a fiber drafting assembly comprising a source of fibrous material, a rotatable opening roll, means for rotatably driving said opening roll, means for advancing said source of fibrous material to said opening roll, and a housing member extending about at least a portion of the circumference of said opening roll, said housing member having a groove located interiorly thereof adapted to receive fibers doffed from said opening roll, said groove being further characterized by having an initial relatively shallow and relatively wide portion tapering to a relatively deep and relatively narrow discharge portion in the direction of fiber advancement.

In preferred aspects of the present invention, said groove has an increasing cross-sectional area in the direction of fiber advancement.

In a still further aspect of the present invention, there is provided a housing member for placement about a portion of the circumference of an opening roll in a fiber drafting assembly, the surface of said housing member adjacent the circumferential surface of said opening roll having, in the direction of fiber advancement, a first groove formed therein, said first groove tapering to a non-grooved portion, and a further groove in said surface adapted to receive fibers doffed from said opening roll.

In a still further aspect of the present invention, in a method of drafting fibrous material to form fibers, there is provided the improvement comprising the steps of supplying an assembly comprising an opening roll having a housing member with a groove located interiorly thereof placed circumferentially of said opening roll, feeding fibrous material to said opening roll, rotating said opening roll to have a peripheral velocity sufficiently high to draft said fibrous material and to doff the drafted fibers into said groove, and withdrawing said fibers from a discharge end of said groove.

In the disclosure and claims of the present application, it will be understood that the term "opening roll" is meant to be generic to any roll or roller which functions to comb or draft fibers from a source of fibrous material. Synonymous terms employed in the art include, for example, lickerin rolls, drafting rolls, combing rolls, particulating rolls, needle rolls, etc.

Generally, in an assembly wherein non-particulate fibrous material is combed or drafted and wherein a substantial parallelization of the fibers is achieved, there is included means for advancing the fibrous material to an opening roll. Such means may be any suitable and can include, for example, a first feed-in roll advancing a source of fibrous material to the opening roll. Normally, the opening roll is rotating at a substantially higher peripheral speed than the peripheral speed of the first or feed-in roll such that a combing and drafting action and parallelization of the fibers occurs upon the transfer of the fibers from the feed-in roll to the opening roll.

After being completely transferred to the opening roll, the fibers have a tendency to be thrown off the roll due to the centrifugal force involved at the high rotational speed at which it is rotatably driven. In this respect, as will be appreciated, the centrifugal force can be substantial and will be sufficient to overcome the frictional force between the fibers and the teeth or needles of the opening roll which would normally tend to retain the fibers on the roll.

The housing member of the present invention is adapted to act as a fiber receiving and directing means for the opening roll when they are "thrown off" or doffed therefrom. The housing member is held in a "fixed" position in the sense that it does not rotate with the opening roll. To this end, the member may be secured to any suitable non-movable portion of the apparatus such as the frame thereof by conventional means. However, it will be understood that the housing member may be movable or adjustable in that its position with respect to the opening roll may be changed. Furthermore, the assembly employing the housing member may have "universal" means for securing the member thereto whereby different sized housing members may be employed for different applications as will be discussed in greater detail hereinafter.

The material of which the cover member is formed is substantially irrelevant to the invention; suitable metallic or plastic materials well known to those skilled in the art may be utilized. However, in this respect, it will be appreciated that the grooved portion which receive the doffed fibers should be of a substantially smooth finish to minimize friction and prevent any "snagging" of the fibers which are doffed from the opening roll.

As aforementioned, the groove which receives the doffed fibers commences with a relatively shallow and wide portion and tapers to form a relatively deep and relatively narrow discharge or exit portion at one end thereof. In one embodiment, the cross-sectional area of the groove increases in the direction of fiber advancement and furthermore, the cross-sectional area may increase in a substantially linear relationship with respect to the arc of the groove for at least a substantial portion of the length thereof.

In one particular aspect of the invention, there is provided a further groove within the surface of the housing member located adjacent to the circumferential surface of the opening roll. Details of this further groove will be described in greater detail in the illustrated embodiment; it suffices to say that such a further groove aids in the drafting of the fibers when a feed-in roll is employed as the means to advance the fibrous material to the opening roll.

In a further aspect of the present invention, there may be provided air bleed means associated with the housing member and more particularly, with the first mentioned groove which receives the doffed fibers from the opening roll. In conjunction with the air bleed, there may be employed a source of pressurized fluidic material; this is not essential to the practice of the present invention and further details are evident in the description of the illustrated embodiment.

The method of the invention, as aforementioned, comprises feeding fibrous material to the opening roll having the above described housing associated therewith, rotating the opening roll to have a high peripheral velocity whereby the fibers will be doffed into the groove of the housing member, and withdrawing said fibers from a discharge end of said groove. These fibers may then be employed in the manufacture of a yarn or for any desired purpose.

As will be appreciated from the above description, the housing member provides substantial advantages in the drafting and combing of fibrous material. It is believed that these objects and advantages will become clear from the following detailed description of preferred embodiments in conjunction with the accompanying drawings, in which.

Figure 1:
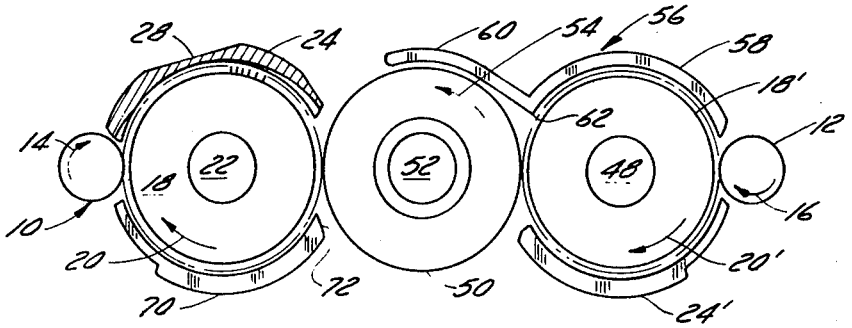
FIG. 1 is a side elevational view of a portion of a composite yarn forming apparatus similar to that described in copending application Ser. No. 507,054.

Referring to the drawings in greater detail and by reference characters thereto, there is illustrated in FIG. 1 an elevational view of a portion of a composite yarn forming apparatus such as that taught in copending patent application Ser. No. 507,054.

As illustrated in FIG. 1, the apparatus includes a pair of feed-in rolls 10 and 12 for feeding fibrous material from a source thereof; feed-in rolls 10 and 12 are rotatably driven in the directions indicated by arrows 14 and 16 respectively.

An opening roll 18 is in juxtaposition to feed-in roll 18 and is journalled on shaft 22 whereby it is rotatably driven by means (not shown) in the direction denoted by arrow 20. In this respect, the means for rotating opening roll 18 may be tied in with the means for rotating feed-in roll 10 if so desired.

The details of opening roll 18 are not illustrated since this roll may, if desired, be of any conventional construction such as shown in copending application Ser. No. 507,054.

The fibrous material is fed to opening roll 18 by feed-in roll 10 and a drafting and combing action of the material is achieved due to the higher peripheral velocity (with respect to feed-in roll 10) at which opening roll 18 is driven. For example, while feed-in roll may have a peripheral velocity of between 2 and 40 feet per minute, the peripheral velocity of opening roll 18 would be in the range of 4,000 and 8,000 feet per minute. Naturally, these peripheral velocities may be varied according to the desired results and operating parameters of the apparatus.

As the fibrous material reaches the nip of rolls 10 and 18, the fibrous material is combed and drafted by the action of the fiber drafting means — i.e. the needles or teeth, to form a plurality of finite fibers which are retained on opening roll 18. The fibers are also generally parallelized in the circumferential direction of the roll.

As may be seen from the Figures, a housing member 24 is circumferentially located for a portion of the circumference of opening roll 18. This housing member extends for the width of the opening roll and it will now be described in greater detail.

Housing member 24 preferably comprises an integral one-piece structure formed of a suitable material such as a metallic or plastics material which has the necessary strength — e.g. aluminum or the like. Means for mounting housing member 24 may comprise those such as shown in the drawings wherein a plurality of threaded apertures such as designated by reference numeral 26 will be employed to mate with correspondingly threaded bolts or screws. In this respect, any means for mounting the same in a fixed relationship with respect to opening roll 18 may be employed.

Housing member 24, as shown in the Figures, is of an overall arcuate configuration having a top surface 28, one end wall 30 arcuately merging with top surface 28 and a further end wall 32. The interior surface opposed to top surface 28 is configurated to operate in conjunction with opening roll 18 during various phases of the operation of the apparatus and will now be discussed. Initially, it will be noted that commencing at end wall 30, there is provided a channel 44 which is of decreasing dimensions (depthwise) to smoothly merge with a further portion 34 of the interior surface. As will be seen in the drawings, portion 34 represents that portion of the interior surface most closely spaced to the opening roll.

Following portion 34, there is formed a second groove having an initial portion 36 which is relatively wide — i.e. it extends a substantial width of member 24. The groove has side walls 38 and 40 which then taper inwardly to form a more narrow groove portion 42. In the illustrated embodiment, the decreasing width of the groove proceeds contemporaneously with an increased depth thereof. In the preferred aspect, the decrease in width and increase in depth is such so that the cross-sectional area of the groove is increasing in the direction of fiber advancement or opening roll rotation.

As the fibers are fed by feed-in roll 10, an initial combing or drafting action is performed which, as aforementioned, is due to the high rotational velocity of opening roll 18 vis-a-vis the rotational velocity of feed-in roll 10. This drafting or combing action is performed during the period of rotation of opening roll 18 which is substantially coextensive with the length of first groove 44. Subsequently, the opening roll performs a straight transportation function for a portion of its rotation and this function is substantially coextensive with portion 34 of the housing member.

As may be appreciated, the high peripheral velocity of opening roll 18 will tend to throw off or doff the fibers due to a high centrifugal force. This force is sufficient to overcome the frictional force between the fibers and fiber drafting means and generally, the fibers commence to be doffed thereat. The fibers thus doffed from opening roll 18 into the groove are directed thereby and ejected or discharged onto a central collecting roll 50 as will be discussed in greater detail hereinafter.

The fibrous material advanced by feed-in roll 12 rotating in the direction of arrow 16 is fed to a further opening roll 18'. Roll 18' may be substantially identical in construction to opening roll 18 and for this reason, is not discussed in great detail herein. Similarly, a cover or housing member 24' is provided which is also substantially identical with respect to the housing member 24 and thus, need not be elaborated on; similar reference numerals with a prime are employed for similar components.

The parallelized fibers from opening roll 18' are ejected onto the central collecting roll 50 which is journalled on a shaft 52 whereby it is suitably rotated in the direction of arrow 54 by conventional means (not shown). Collecting roll 50 may be of the type described in copending patent application Ser. No. 507,054, i.e. it includes a central collecting trough for receiving the fibers from opening roll 18'. The fibers thus transferred thereon are transported and combined with fibers from opening roll 18 and a composite yarn form as described in the aforementioned copending application is formed.

As will be seen from FIG. 1, a further cover member 56 of a one-piece structure is provided for a portion of the periphery of both opening roll 18' and collecting roll 50. The purpose of cover member 56 is to aerodynamically direct the fibers which have been transferred from opening roll 18' in their proper direction. Thus, as aforementioned, the rolls are operating at extremely high peripheral velocities and during the transfer of the fiber from opening roll 18', there is the tendency for the fibers to "bounce" from the central collecting trough onto which they are directed and up in the air. As will be seen from the Figures, cover member 56 has a first portion 58 about a portion of the periphery of roll 18' and a further portion 60 about the periphery of roll 50 with the junction point 62 being in a closely spaced relationship to the surface of roll 18'. As the fibers are doffed from the groove in member 24' due to centrifugal force, member 60 will aerodynamically direct the fibers onto the central collecting channel or trough of roll 50 and tend to retain them in their proper position in the channel.

It will also be noted that a housing member 70 is provided about the bottom periphery of roll 18. End wall 72 of member 70 is of an angled construction to also assist in the aerodynamic functioning of the doffing of the fibers onto the central collecting roll 50.

In one embodiment of the present invention, there may be provided pneumatic means to maintain the speed of the fibers which are travelling in the grooved housing member. To this end one or more air jets may be employed directing a source of pressurized air to the groove in the direction of travel of the fibers; the necessity and desirability of having such air jets depends on factors known to those skilled in the art — i.e. the type of fiber and length thereof.

Due to the high velocity at which the opening rolls are travelling, there is created a reduced pressure area proximate to portion 36 of the groove. This aids in the doffing of the fibers from the opening roll.

Figure 2:
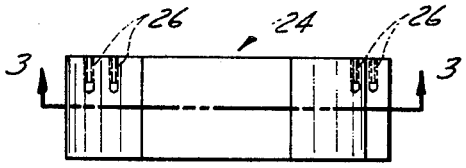
FIG. 2 is a top view of the novel housing member illustrated in FIG. 1.
Figure 5:
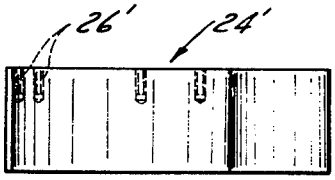
FIG. 5 is a top view of a further embodiment of the housing member according to the present invention.
Figure 3:
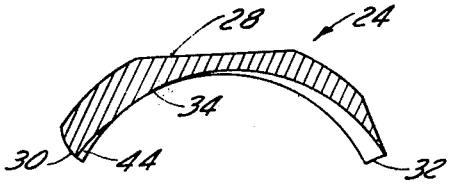
FIG. 3 is a cross-sectional view taken along the lines 3—3 of FIG. 2.
Figure 6:
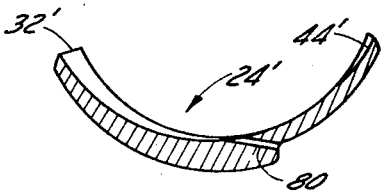
FIG. 6 is a side sectional view taken along the lines 6—6 of FIG. 7.
Figure 4:
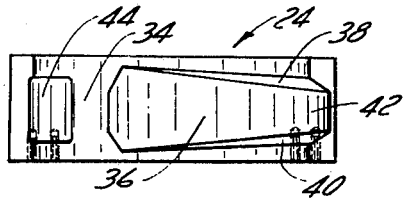
FIG. 4 is a bottom view of the housing member of FIGS. 2 and 3.
Figure 7:
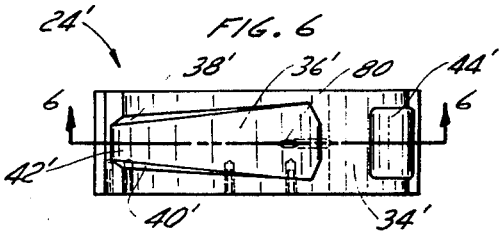
FIG. 7 is a bottom view of the housing member of FIGS. 5 and 6.

A further embodiment is illustrated in FIGS. 5 to 7 and reference will now be made thereto. In this respect, these Figures illustrate a housing member similar to that illustrated in FIGS. 2 to 4 and similar reference numerals with a prime are employed for identical components.

In greater detail, the housing member 24' illustrated in FIGS. 5 to 7 employs an air bleed 80. Air bleed 80 may be any suitable conduit or aperture in the housing and preferably communicates with the relatively shallow and wide portion 36' of the groove. Even more preferably, air bleed 80 is positioned substantially tangentially to the groove.

As aforementioned, pneumatic means may be employed to maintain or boost the speed of the fibers which are doffed into the groove. Thus, a source of pressurized gaseous material may be fed through air bleed 80 to achieve this end. The source of pressurized gaseous material such as air may be any suitable; it will be understood that the pressure at which the gaseous material is fed will be relatively low so as to not interfere or prevent the doffing of the fibers from the opening roll into the groove.

In a design of a housing member such as is designated by reference numeral 24 or 24', portion 34 or 34' must be of a sufficient length to permit a sufficient combing and drafting action on the fibrous material. As will be appreciated, if the front end of a fiber has commenced being doffed into the groove while the tail end is still being fed in, a "tumbling" action will occur at the front end of the fiber. This is undesirable and accordingly, portion 34 of the housing member is of a sufficient length to prevent this tumbling action from occurring.

As previously discussed, the overall length of a housing member as taught by the present invention may be variable depending on the type of fibers and length of fibers employed. To this end, preferably universal mounting means are employed whereby the apparatus may receive various different cover members by their universal mounting means. This would be particularly the case for longer fibers wherein the take off point would be more to the right of roll 18 as shown in FIG. 1.

It will be obvious from the above description that many changes and modifications may be made to the above described embodiment without departing from the spirit and scope of the invention which is not limited thereby, but rather by the claims appended hereto.

I claim:

1. In a fiber drafting assembly comprising a rotatable opening roll, means for feeding fibrous material to said opening roll, the improvement comprising a housing member extending about at least a portion of the circumference of said opening roll, said housing member having a groove located interiorly thereof adapted to receive fibers doffed from said opening roll, said groove being open throughout its length to the circumferential surface of said opening roll having an initial relatively shallow and relatively wide portion tapering to a relatively deep and relatively narrow discharge portion in the direction of fiber advancement, said groove increasing in cross-sectional area in the direction of fiber advancement.

2. The assembly of claim 1 wherein said means for feeding said source of fibrous material to said opening roll comprises a rotatably driven feeding roll.

3. The fiber drafting assembly of claim 1, wherein the assembly includes a pair of opening rolls, a grooved suction roll intermediate said pair of opening rolls and being in operative relationship with respect thereto, each of said opening rolls having one of said housing members extending about at least a portion of its circumference.

4. The assembly of claim 1, wherein said housing member includes a second groove located interiorly thereof, said second groove being located in advance of said first groove in the direction of fiber advancement.

5. The assembly of claim 1 wherein said groove, in cross-sectional configuration, has a bottom surface all transverse sections of said opening roll and a pair of opposed walls tapering inwardly towards said bottom surface.

6. The assembly of claim 1, wherein said housing member includes an aperture communicating with said groove, said aperture being located proximate the initial relatively shallow portion thereof.

7. The assembly of claim 6 wherein said aperture is substantially tangential to said groove.

8. In a fiber drafting assembly comprising a rotatable opening roll, means for feeding fibrous material to said opening roll, the improvement wherein the fiber drafting assembly includes a housing member extending about at least a portion of the circumference of said opening roll, said housing member having first and second grooves located interiorly thereof, said first groove being located proximate to the means for feeding the fibrous material to the opening roll and being of a decreasing depth and smoothly merging with a portion intermediate said first and second grooves, said second groove being open throughout its length to the circumferential surface of said opening roll, said second groove having an initial relatively shallow and relatively wide portion tapering to a relatively deep and relatively narrow discharge portion in the direction of fiber advacement and having an increasing cross-sectional area in the direction of fiber advancement, and an aperture communicating with the initial shallow and relatively wide portion of said second groove.

* * * * *